US007223949B2

(12) United States Patent
Deka et al.

(10) Patent No.: US 7,223,949 B2
(45) Date of Patent: May 29, 2007

(54) ANALYSIS APPARATUS HAVING IMPROVED TEMPERATURE CONTROL UNIT

(75) Inventors: Chiranjit Deka, Andover, MA (US); Arthur W. Miller, Woburn, MA (US); Sunil S. Deliwala, Placentia, CA (US); Barry L. Karger, Newton, MA (US)

(73) Assignee: Beckman Coulter, Inc., Fullerton, CA (US)

( * ) Notice: Subject to any disclaimer, the term of this patent is extended or adjusted under 35 U.S.C. 154(b) by 11 days.

(21) Appl. No.: 10/828,929

(22) Filed: Apr. 21, 2004

(65) Prior Publication Data

US 2005/0247701 A1 Nov. 10, 2005

(51) Int. Cl.
*H05B 3/10* (2006.01)

(52) U.S. Cl. ..... 219/548; 219/531; 219/538; 219/552; 210/198.2; 435/91.2

(58) Field of Classification Search ..... 219/548, 219/531, 538, 552; 165/253, 48.1; 207/601; 210/198.2, 656; 435/91.2, 6, 91.1
See application file for complete search history.

(56) References Cited

U.S. PATENT DOCUMENTS

| | | | | |
|---|---|---|---|---|
| 5,641,400 | A * | 6/1997 | Kaltenbach et al. | 210/198.2 |
| 5,965,410 | A * | 10/1999 | Chow et al. | 435/91.2 |
| 6,406,605 | B1 * | 6/2002 | Moles | 204/601 |
| 6,423,536 | B1 | 7/2002 | Jovanovich et al. | |
| 6,640,891 | B1 * | 11/2003 | Oldenburg | 165/253 |

FOREIGN PATENT DOCUMENTS

| | | |
|---|---|---|
| EP | 0318273 A2 | 5/1989 |
| WO | WO 98/08978 | 3/1998 |
| WO | WO 01/31053 A1 | 5/2001 |

OTHER PUBLICATIONS

Search Report dated Jul. 25, 2005, for corresponding International Application No. PCT/US2005/013558.
Burns, Mark A. et al.; "An Integrated Nanoliter DNA Analysis Device"; *Science* 1998, vol. 282, pp. 484-487.

* cited by examiner

*Primary Examiner*—Robin Evans
*Assistant Examiner*—L Fastovsky
(74) *Attorney, Agent, or Firm*—Maginot, Moore & Beck

(57) ABSTRACT

An apparatus for use in controlling the temperature of one or more substances passing through one or more microfluidics channels in an analysis device is set forth. The apparatus includes a heating unit having first and second surfaces. The first surface of the heating unit is constructed so that it is at least partially exposed for cooling of the heating unit. The apparatus also includes a thermally conductive medium that is disposed proximate the second surface of the heating unit. The one or more microfluidics channels are disposed in the thermally conductive medium. In one embodiment, the one or more microfluidics channels are in the form of a plurality of capillary columns, such as those used in instruments for capillary electrophoresis. Each capillary column is substantially surrounded by the material forming the thermally conductive medium. In another embodiment, the thermally conductive medium, along with the corresponding plurality of capillary columns, can be easily disengaged from the heating unit in a non-destructive manner thereby allowing the heating unit to be reused.

48 Claims, 7 Drawing Sheets

165
35
155
40
95
105
110
160
170
115
80
180
175

ANALYSIS APPARATUS HAVING IMPROVED TEMPERATURE CONTROL UNIT

FIELD OF THE INVENTION

The present invention is generally directed to substance analysis apparatus. More particularly, the present invention is directed to a chemical/biological analysis apparatus having an improved temperature control unit for controlling the temperature of a substance passing through a microfluidic channel, such as a capillary column.

BACKGROUND OF THE INVENTION

Accurate and reproducible temperature control is required for a large number of applications in biological and chemical analysis. Such temperature control may require either a stable constant temperature over a definite time period or a temperature that varies in a predetermined manner during the overall analytical process. In general, techniques for molecular separation often benefit from temperature control. Biochemical and biophysical reactions occurring in connection with cellular assays and assays for blood chemistry and immunology also frequently involve steps that require controlled temperature.

Capillary electrophoresis is recognized as a powerful technique that can separate molecules based on size and/or charge and is one analysis technique that increasingly requires such accurate and reproducible temperature control. For example, certain applications for molecular separation by capillary electrophoresis depend on maintaining constant temperature over a predetermined length of the capillary. Such applications include DNA sequencing and constant denaturant capillary electrophoresis. Other applications rely on increasing or decreasing the temperature over a predetermined length of the capillary in accordance with a predefined temperature profile (i.e. temperature gradient capillary electrophoresis and cycling temperature capillary electrophoresis).

Recent work in the area of capillary electrophoresis has given rise to a method for periodically varying the temperature of an air oven to conduct mutation analysis in a modified DNA sequencer. However, such processes are often difficult to control in a conventional air oven. By using the air oven to control the temperature of a substance passing through a capillary column, the periodicity and amplitude of the temperature cycles are highly dependent on the overall volume of the oven chamber and the typically large combined heat capacity of everything in it. Rapid and accurate temperature control is virtually impossible to achieve. Relatively complex electromechanical configurations are also required to achieve even a minimal degree of temperature control.

In U.S. patent application Ser. No. 09/979,622, filed on Mar. 7, 2000, Foret et al. describe an apparatus that may be used to control the temperature of a substance passing through a capillary column. As shown in FIG. 2 of that application, the apparatus includes a heater body that is constructed as a cylindrical volume of thermally conductive material. The heater body is completely surrounded by an electrically powered heating element that, in turn, is completely surrounded by a cylinder constructed from a thermally insulating material. The thermally conductive material has a hole drilled through its length. A stainless steel tube is inserted through this hole and is permanently embedded within the thermally conductive material using thermal epoxy. The capillary, carrying a gel matrix through which the sample is to travel, is passed through this stainless steel tube. A plurality of these structures are combined to form a capillary array. Each individual capillary column of the capillary array is thermally insulated from every other individual capillary column.

A stated application of the Foret et. al. apparatus is constant denaturant capillary electrophoresis (CDCE). However, the present inventors have recognized several disadvantages inherent in the design of this apparatus that can make it unsuitable for CDCE applications (as well as other temperature dependent analytical processes) on a large commercial scale. For example, it is difficult to efficiently and economically incorporate the apparatus into existing analyzer designs. Generally speaking, the apparatus can also be difficult to manufacture and use due to its complex design. In addition, the temperature of the apparatus is difficult to accurately reset to an initial target temperature. Further, the overall concentric construction of the apparatus is designed to maintain long-term temperature stability at the expense of speed in achieving a target temperature. This may make the apparatus difficult to use in processes requiring a rapidly varying temperature profile.

SUMMARY OF THE INVENTION

An apparatus for use in controlling the temperature of one or more substances passing through one or more microfluidics channels in an analysis device is set forth. The apparatus comprises a heating unit having first and second surfaces. The first surface of the heating unit is constructed so that it is at least partially exposed for cooling of the heating unit. The apparatus also comprises a thermally conductive medium that is disposed proximate the second surface of the heating unit. The one or more microfluidics channels are disposed in the thermally conductive medium. In one embodiment, the one or more microfluidics channels are in the form of a plurality of capillary columns, such as those used in instruments for capillary electrophoresis. Each capillary columns is substantially surrounded by the material forming the thermally conductive medium. In another embodiment, the thermally conductive medium, along with the corresponding plurality of capillary columns, can be easily disengaged from the heating unit in a non-destructive manner thereby allowing the heating unit to be reused.

DESCRIPTION OF ONE OR MORE PREFERRED EMBODIMENTS OF THE INVENTION

The apparatus of the present invention can be adapted for use in a wide range of biological and chemical analysis instruments that require static and/or varying temperature control of a substance passing through a microfluidic flow channel, such as a capillary column. For example, the apparatus can be adapted for use in instruments employed in flow cytometry, liquid chromatography, gas chromatography, capillary electrophoresis, etc. For purposes of the following discussion, various embodiments of the apparatus will be described in the context of a capillary electrophoresis system suitable for constant and/or varying temperature processes.

Figure 1:
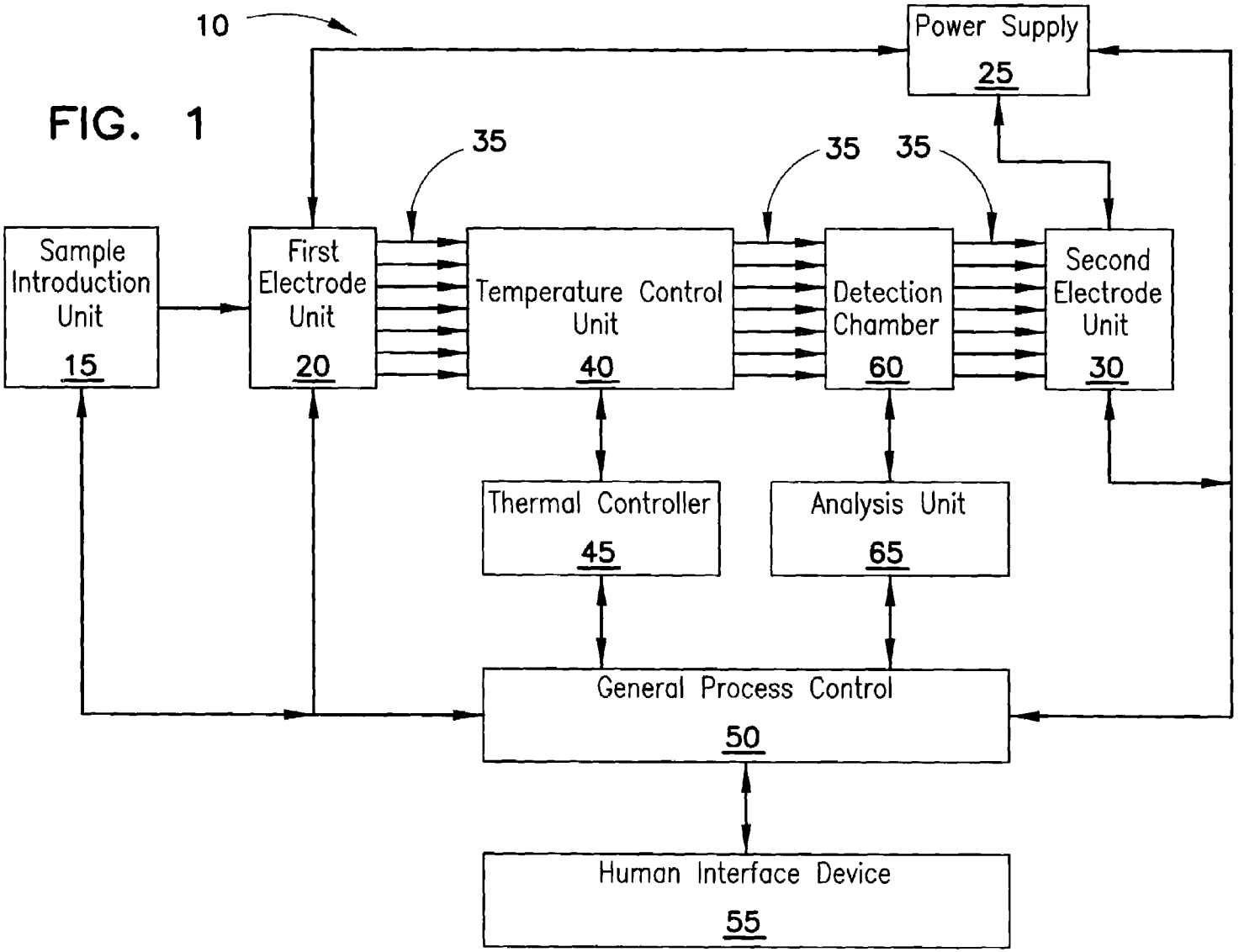
FIG. 1 is a schematic diagram of one embodiment of a capillary electrophoresis system that may use an improved temperature control unit.

FIG. 1 illustrates one embodiment of a capillary electrophoresis system, shown generally at 10. As shown, the electrophoresis system 10 includes a sample introduction unit 15 that provides one or more substances that are to be analyzed. The samples are provided to the input of a first electrode unit 20. The first electrode unit 20 typically includes an electrode disposed in a buffer solution. The buffer solution serves as a solvent for the one or more substances that are to be analyzed.

The one or more substances that are to be analyzed are driven from the first electrode unit 20 to a second electrode unit 30 under the influence of an electric field generated between the corresponding anode and cathode. To this end, the electrode of the first electrode unit 20 is connected to a first terminal of power supply 25 and may serve as either the anode or cathode depending on the analyte. A second electrode is disposed in a buffer solution in the second electrode unit 30 and is connected to a second terminal of the power supply 25. The second electrode may serve as the other of the anode or cathode depending on the particular analyte involved in the capillary electrophoresis process.

The buffer solution containing the substance(s) for analysis proceeds from the first electrode unit 20 and flows toward the second electrode unit 30 through a plurality of capillary columns 35. Samples can be introduced into the capillary columns 35 using established hydrodynamic or electrokinetic injection methods. Each capillary column 35 of the capillary array may have either the same or different instructions. For example, the capillaries may comprise a fused silica interior that is surrounded by a polyimide coating. Other capillary constructions may include a porous gel through which the samples must travel.

Capillary columns 35 pass through a temperature control unit 40. Temperature control unit 40, as will be discussed in further detail below, is adapted to quickly drive the temperature of the capillary columns 35 to a given target temperature. The target temperature may be held constant over the duration of the capillary electrophoresis process or may be quickly varied during the process in accordance with a predetermined temperature profile.

Temperature control unit 40 cooperates with a thermal controller 45 to execute the predetermined temperature profile. To this end, temperature control unit 40 includes one or more temperature sensors that are disposed to monitor the temperature at selected portions of the temperature control unit 40. Thermal controller 45 is responsive to the signals provided by the one or more temperature sensors and adjusts, for example, the power provided to the heating unit of the temperature control unit 40 accordingly. Thermal controller 45 may be microprocessor based and may execute the predetermined temperature profile in response to user input parameters. The input parameters may be communicated to the thermal controller 45 through a general process controller 50 that, in turn, receives temperature processing parameters or the like from an operator at a corresponding human interface device 55. Human interface device 55 may take on various forms including, but not limited to, a keyboard, a touchscreen monitor, etc.

Alternatively, an existing capillary electrophoresis instrument may be retrofit with a stand-alone temperature control retrofit package including a temperature control unit 40 and thermal controller 45 having its own, independent human interface device. In such instances, the temperature control unit 40 and thermal controller 45 are constructed to operate beyond the direct control of the existing portions of the instrument. Further, although the embodiment of FIG. 1 includes only a single temperature control unit, it will be recognized that a plurality of such control units may be disposed in parallel with or in series with one another, depending on processing requirements.

Notwithstanding the data entry method, the thermal controller 45 ultimately receives temperature parameters and drives the temperature control unit 40 in accordance with a predetermined temperature profile based on those parameters. The predetermined temperature profile may be static or dynamic. In the case of a dynamic profile, for example, thermal controller 45 may generate a waveform comprised of discrete target values in response to a cycle period and temperature amplitude range input by the human operator. These target values, in turn, may be used to control the operation of a typical PID controller to drive the state of the temperature control unit 40 to the desired temperature values over time.

The samples exiting temperature control unit 40 through capillary columns 35 are provided to the input of a detection chamber 60. Within detection chamber 60 there are one or more sensors that are disposed to detect one or more parameters of the sample as it passes therethrough. Such parameters include, for example, electromagnetic absorbance, fluorescence, mass spectrometry, amperometry, conductivity, etc. The operation of the sensors may be controlled by an analysis unit 65. Analysis unit 65 is further programmed to receive the data from the sensors within detection chamber 60 and provide it to the general process controller 50 for printing or other display in an intelligent format susceptible of direct or indirect interpretation by a user.

Samples passing through capillary columns 35 exit detection chamber 60 and ultimately flow into the second electrode unit 30. Samples arriving at the second electrode unit 30 may be discarded or provided to the input of yet another analysis unit of the same or different type.

Figure 2:
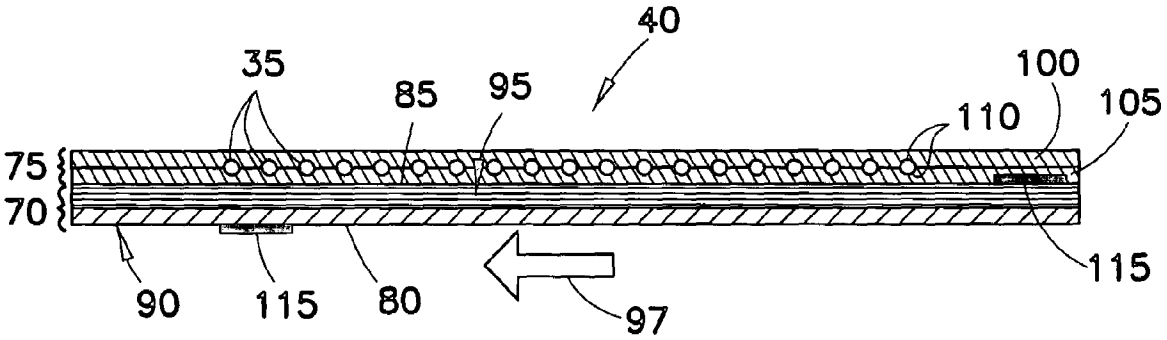
FIG. 2 is a cross-sectional view of one embodiment of a temperature control unit suitable for use in the capillary electrophoresis system shown in FIG. 1.

FIG. 2 illustrates one embodiment of a temperature control unit 40 suitable for use in the capillary electrophoresis system 10 shown in FIG. 1. In this embodiment, the temperature control unit 40 is generally comprised of a heating unit 70 and a thermally conductive medium 75 in which an array of capillary columns 35 are disposed. Heating unit 70 may be generally planar in shape and have a first side 80 that is at least partially exposed to facilitate cooling of the heating unit. Cooling at first side 80 may be facilitated in accordance with any one of a variety of different methods. For example, first side 80 may merely be exposed to ambient environment conditions. Alternatively, a flow of cooling gas or liquid may be driven into contact with the first side 80, as generally shown by arrow 97. Still further, a cooling unit, such as a Peltier cooler, may be disposed proximate first side 80 to cool heating unit 70 in response to electrical signals and/or power received from thermal controller 45.

Heating unit 70 may consist of a single heating element 90 or, as shown in FIG. 2, may be formed as a multilayer composite. Heating element 90, for example, may be in the form of a thermofoil heater, such as one available from Minco™. In the illustrated multilayer composite, heating unit 70 is comprised of heating element 90 and an intermediate conductive or convective layer 95 that is disposed between heating element 90 and thermally conductive medium 75. Layer 95 may be comprised of a thermally conductive gas, liquid or solid. In the illustrated embodiment, layer 95 is comprised of a thin metal plate of, for example, aluminum or copper.

Thermally conductive medium 75 is disposed proximate a second side 85 of the heating unit 70 in such manner as to allow effective thermal energy transfer therebetween. In turn, thermally conductive medium 75 is used to transfer thermal energy to and from the capillary columns 35 of the capillary array. In order to maximize this thermal energy transfer, it is desirable to maximize the surface contact between the exterior walls of the capillary columns 35 and medium 75. To this end, thermally conductive medium 75 is preferably formed from a material that may be molded to conform to the shape of the capillary columns 35. This may be achieved in a variety of different manners. For example, the moldable material used to form medium 75 may be comprised of a pair of thermally conductive sheets 100 and 105 that are adapted to closely fit capillary columns 35 therein when the sheets 100 and 105 are brought together in the illustrated manner. Preferably, the material used to form the sheets is sufficiently deformable so as to substantially engage and substantially surround the capillary columns 35 when the sheets are pressed together. Various conductive rubber materials, such as silicone, can be used to form a medium 75 having such characteristics. Sheets 100 and 105 may alternatively include pre-manufactured slots 110 into which the capillary columns 35 are placed. The capillary columns 35 are secured within the pre-manufactured slots 110, for example, with a thermal paste whereby a thermally conductive material completely surrounds each column.

Although FIG. 2 shows thermally conductive medium 75 formed as two distinct sheets, medium 75 may likewise be formed from a single sheet of material. For example, thermally conductive medium 75 may be formed by directly pouring or painting a thin layer of thermally conductive silicone rubber material in its semi-liquid form onto surface 85 and around the capillary columns 35 of capillary array, setting capillary columns 35 therein and letting the material mold or cure itself into a thin, solid rubber sheet.

Preferably, a high thermal conductivity silicone gel is used to form the thermally conductive medium 75. The objective is to ensure efficient heat transfer to and from the heating unit 70 and medium 75 to ultimately control the temperature of the substances passing through the corresponding capillary columns 35. Thermal conductivities equal to or greater than 0.5 W/(m.k) are desirable, with thermal conductivity values greater than 1.00 W/(m.k) being preferable. Heat-dissipating silicone gels having thermal conductivities as high as 1.26 W/(m.k) are available from Asahi Rubber.

Thermally conductive medium 75 preferably has a thickness between 0.05 mm to 5 mm. In most instances, enclosing the capillary columns 35 between two 1 mm thick sheets of silicone gel is sufficient. Thinner silicone gel sheets (i.e., 0.3 mm thick sheets) are also commercially available and may be employed in the temperature control unit 40.

FIG. 2 also illustrates exemplary placement of one or more temperature sensors 115 in the temperature control unit 40. For example, a first one of the temperature sensors 115 may be disposed at the first side 80 of heating unit 70 proximate heating element 90 while a second one of the temperature sensors 115 may be disposed at the second side 85 proximate thermally conductive medium 75. Signals provided by one or both of the temperature sensors 115 are received at thermal controller 45 and used to monitor the temperature at the selected portions of the temperature control unit 40 so that thermal controller 45 can properly drive temperature control unit 40 in accordance with the predetermined temperature profile.

Figure 3:
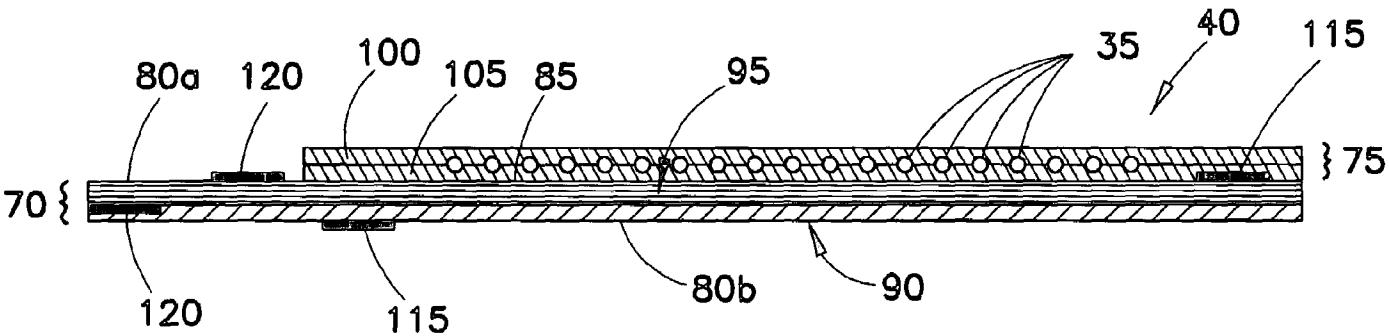
FIG. 3 is a cross-sectional view of a second embodiment of a temperature control unit suitable for use in the capillary electrophoresis system shown in FIG. 1.

FIG. 3 illustrates an alternative embodiment of temperature control unit 40. In this embodiment, heating unit 70 extends beyond the perimeter of the thermally conductive medium 75 so that the exposed cooling surface 80*a* and second surface 85 are disposed at the same side of the heating unit 70 and are generally coplanar with one another. One or more further temperature sensors 120 may be disposed in the extended region proximate the exposed cooling surface 80*a*. Surface 80*b*, which is disposed opposite surface 85, may be partially or fully insulated or, as illustrated, exposed to increase the area available for cooling of the heating unit 70. Any of the cooling techniques noted above may be applied to surface 80*a* and/or surface 80*b*.

Figure 4:
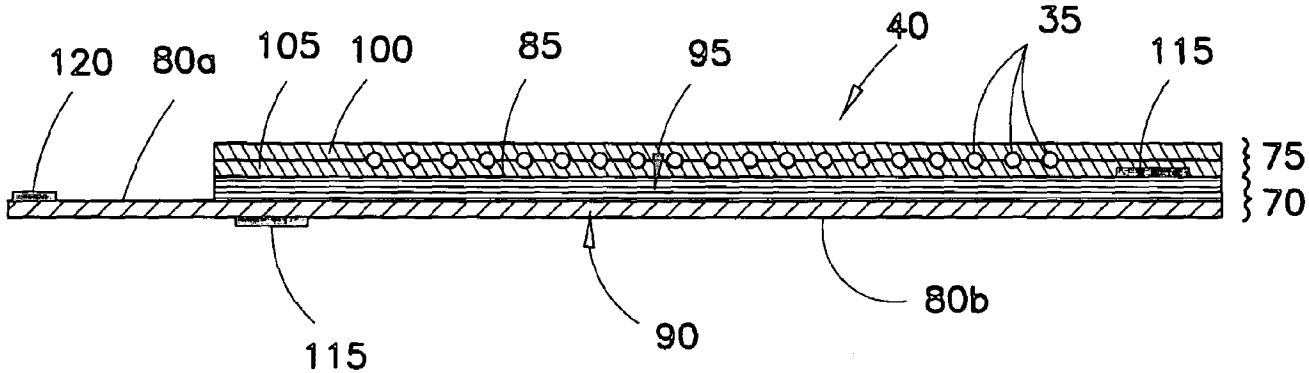
FIG. 4 is a cross-sectional view of a third embodiment of a temperature control unit suitable for use in the capillary electrophoresis system shown in FIG. 1.

FIG. 4 illustrates a still further embodiment of the temperature control unit 40. This embodiment is somewhat similar to the embodiment shown in FIG. 3. However, only the heating element 90 extends beyond the perimeter of the thermally conductive layer 75.

Figure 5:
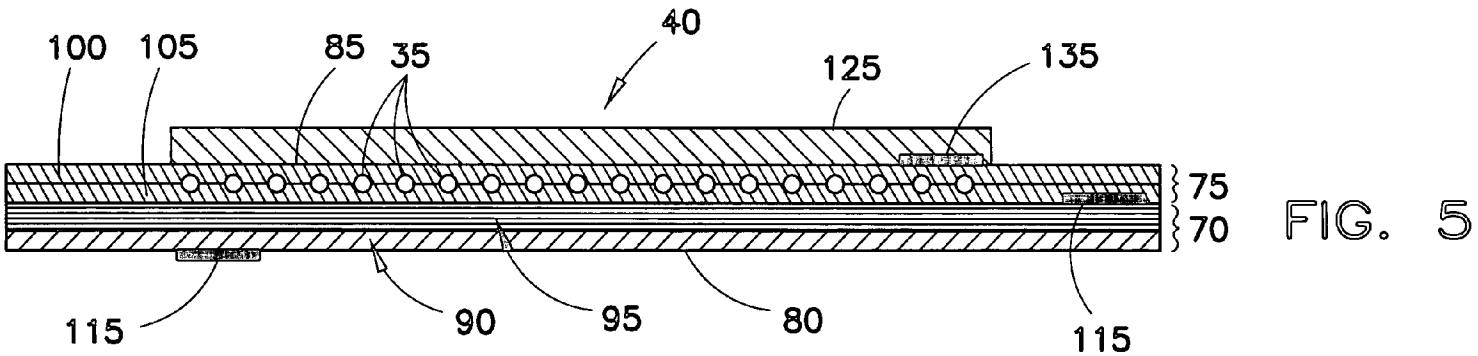
FIG. 5 is a cross-sectional view of a fourth embodiment of a temperature control unit suitable for use in the capillary electrophoresis system shown in FIG. 1.
Figure 6:
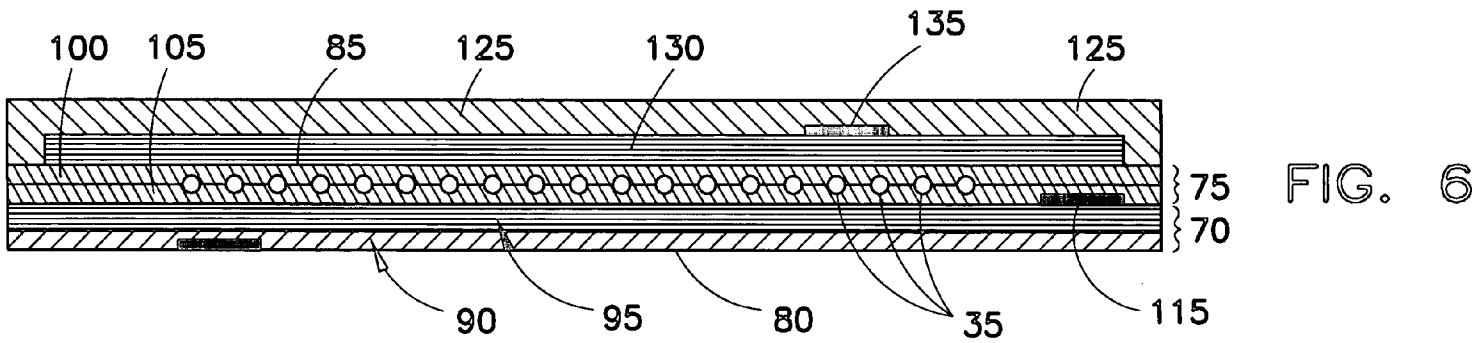
FIG. 6 is a cross-sectional view of a fifth embodiment of a temperature control unit suitable for use in the capillary electrophoresis system shown in FIG. 1.

FIGS. 5 and 6 illustrate embodiments of the temperature control unit 40 in which an insulating layer 125 is disposed over at least a portion of the surface of the thermally conductive medium 75. In the embodiment of FIG. 5, the insulating layer 125 is disposed directly over only that portion of the surface of the thermally conductive medium 75 which is coextensive with the array of capillary columns 35. In contrast to the direct contact between the thermally conductive medium 75 and the insulating layer 25 shown in FIG. 5, the embodiment of FIG. 6 includes a thermal insulating layer 125 that is disposed over an additional intermediate conductive layer 130. Intermediate conductive layer 130 is at least coextensive with the array of capillary columns 35. In each embodiment, a further temperature sensor 135 is provided to measure the temperature at the interiorly disposed surface of the insulating layer 125. Embodiments of the temperature control unit 40 employing the illustrated thermal insulating layer 125 are particularly useful in analytical processes requiring strict temperature stability and gradual cooling ramps.

Figure 7:
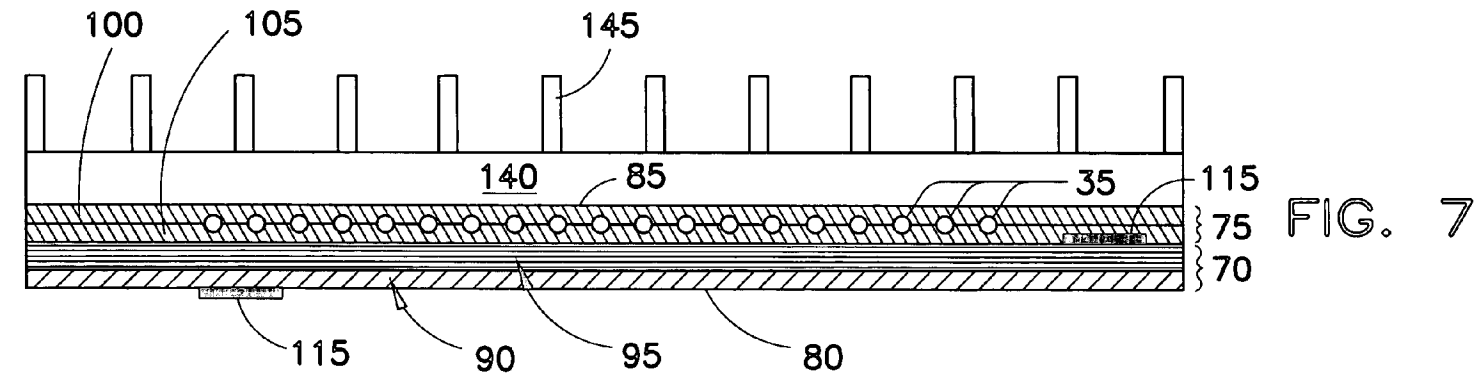
FIG. 7 is a cross-sectional view of a sixth embodiment of a temperature control unit suitable for use in the capillary electrophoresis system shown in FIG. 1.

FIG. 7 illustrates an embodiment of the temperature control unit 40 that is particularly useful in analytical processes requiring high cooling rates in the processing temperature profile. In this embodiment, a heat dissipation unit 140 is disposed proximate the thermally conductive medium 75. The heat dissipation unit 140 may be an active device, such as a Peltier cooler, or a passive layer, such as a metal layer. As shown, the heat dissipation unit 140 may be disposed directly on the outer surface 85 of medium 75 to dissipate heat as needed. Preferably, thermal controller 45 is used to control the operation of heat dissipation unit 140 in response to the predetermined temperature profile required for the analytical process in those instances in which the heat dissipation unit 140 is an active device. Although the heat dissipation unit 140 shown in FIG. 7 is coextensive with the entire outer surface 85 of medium 75, only a portion of the outer surface may be so contacted. To further enhance the heat dissipation abilities of the unit 140, it may be provided with a plurality of fin-shaped heat sinks 145.

In each of the foregoing embodiments, the thermally conductive medium 75 and the heating unit 70 may be constructed so that the thermally conductive medium 75, along with the corresponding capillary array, can be secured with and separated from heating unit 70 in a non-destructive manner. Releasable securement of these elements can be achieved using one or more of a variety of securement techniques. For example, a thermally conductive adhesive may be applied at the interface between heating unit 70 and thermally conductive medium 75. Alternatively, non-destructive, releasable securement may be achieved using an intermediate thermally conductive layer having an adhesive on both sides thereof. In either instance, the adhesive may be in the form of a separately applied layer or may be in the form of a tacky surface inherently produced by the material used as the thermally conductive layer (i.e., the inherent tackiness of a silicone gel layer). Still further, standard mechanical fasteners (i.e., screws, clamps, tape, etc.) may be used to secure the heating unit 70 and thermally conductive medium 75 together.

When the temperature control unit 40 is manufactured so that the thermally conductive medium 75 is readily separated from the heating unit 70 without damage to the heating unit 70, the thermally conductive medium 75 including the corresponding capillary column array may constitute a disposable element of the overall unit 40. As such, the thermally conductive medium 75 and the spent capillary columns 35 may be readily removed from the heating unit 70 and replaced with a new thermally conductive medium 75 having new capillary columns 35 when necessary. This capability makes the use of the temperature control unit 40 highly economical in instances in which the effective life of the capillary columns 35 is shorter than the effective life of the elements comprising the heating unit 70.

Figures 8A, 8B, 8C:
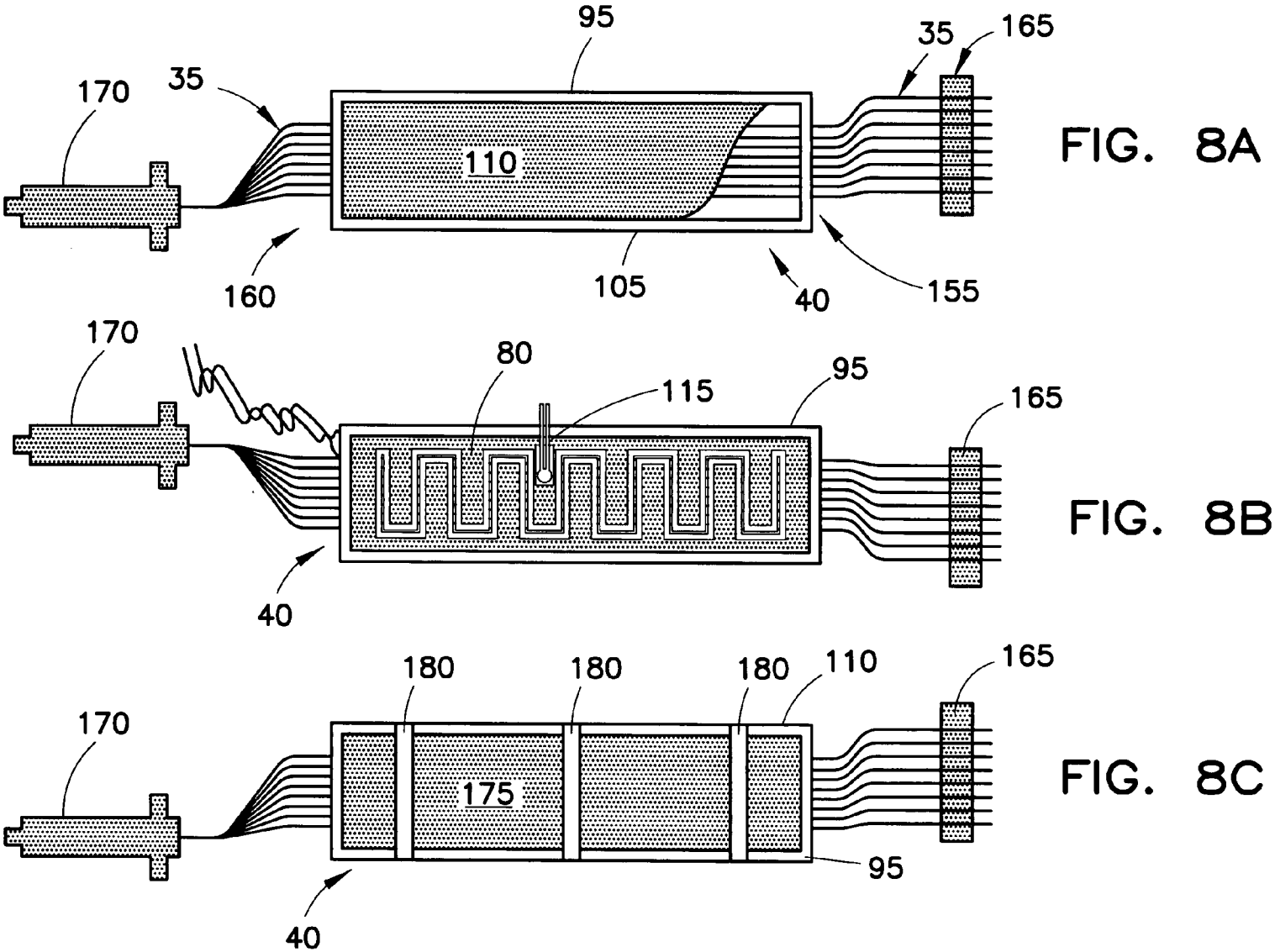
FIGS. 8A through 8C illustrate an embodiment of a temperature control unit similar to the one shown in FIG. 2 as it may be adapted into an overall capillary insertion unit for use in a corresponding analysis apparatus.

FIGS. 8A through 8C illustrate an embodiment of the temperature control unit similar to the one shown in FIG. 2 as it may be adapted into an overall capillary insertion unit 150 for use in a corresponding analysis apparatus. FIG. 8A is a top partial cross-sectional view of the insertion unit 150 while FIGS. 8B and 8C are bottom and top plan views thereof. As shown in each view, a plurality of capillary columns 35 extended from each end 155 and 160 of temperature control unit 40. The capillary columns 35 extending from end 155 are attached to an inlet unit 165 that is adapted to receive the sample from the corresponding analysis apparatus. Similarly, the plurality of capillary columns 35 extending from end 160 proceed to engage an outlet unit 170 that is adapted for connection to a subsequent section of the corresponding analysis apparatus, such as the detection chamber portion thereof. As shown in FIG. 8C, an additional metal plate 175 is disposed over at least a portion of the exterior surface of conductive rubber sheet 110 and the entire temperature control unit is held together with, for example, strips of thermal tape 180. An exemplary capillary holder for use in the capillary insertion unit 150 is shown in U.S. Pat. No. 5,900,132, issued on May 4, 1999 to Keenan et al., entitled "Capillary Holder".

Capillary insertion unit 150 may be provided as a single assembly to an end-user of the analysis apparatus thereby greatly simplifying the installation process. Although a specific construction for the temperature control unit 40 a shown in connection with the insertion unit 150, it will be recognized that any of the embodiments discussed herein may be provided in the form of unit 150.

Figure 9A:
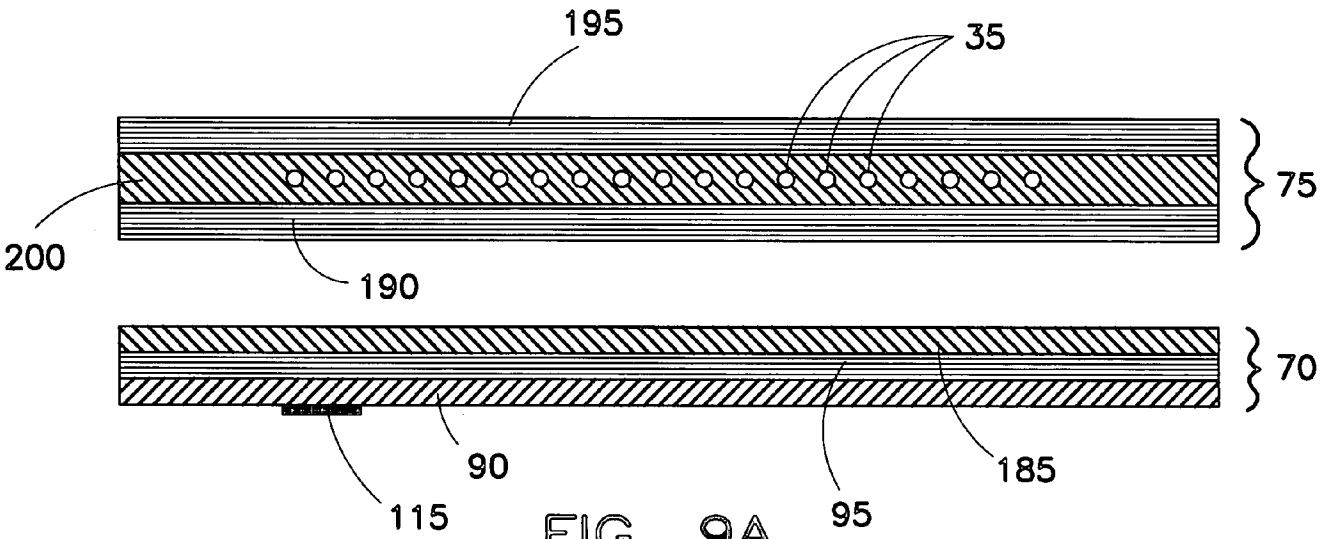
FIGS. 9A and 9B illustrate a further embodiment of a temperature control unit in which the thermally conductive medium portion and the heating unit portion of the temperature control unit are manufactured as completely separate and separable units.
Figure 9B:
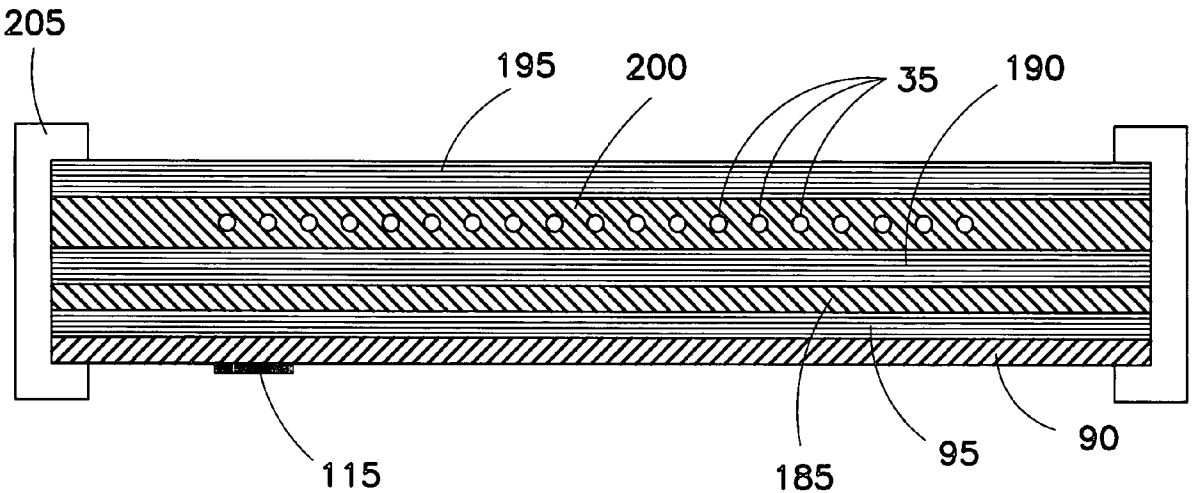

FIGS. 9A and 9B illustrate a further embodiment of a temperature control unit 30 that is particularly suitable for widespread and economical commercial use. In this embodiment, the thermally conductive medium 75 portion and the heating unit 70 portion of the temperature control unit 30 are manufactured as completely separate and separable units. Heating unit 70 is comprised of three adjacent layers. First, a heating element 90 is disposed as the lower layer of the overall unit and has a lower surface that is at least partially exposed for cooling. An intermediate thermally conductive layer 95, preferably formed from a metal, is disposed over a first side of the heating element 90. Finally, a thin layer of conductive rubber 185 is disposed over the intermediate thermally conductive layer 95 and forms the uppermost layer of the heating unit 75.

The thermally conductive medium 75 of this embodiment is likewise comprised of three layers. More particularly, thermally conductive medium 75 includes a lower thermally conductive layer 190 and an upper thermally conductive layer 195 that sandwich an intermediate thermally conductive rubber layer 200 therebetween. Preferably, layers 190 and 195 are formed from thermally conductive metal plates. The plurality of capillary columns 35 are substantially surrounded by the material forming conductive rubber layer 200 to thereby maximize thermal energy transfer between the capillary columns and the surrounding medium. Conductive rubber layer 200 may be constructed in one of the manners described above.

In commercial use, thermally conductive medium 75 and heating unit 70 may be provided as separate commercial units. Heating unit 70 may thus be reused with multiple thermally conductive mediums 75. FIG. 9B shows the heating unit 70 and the thermally conductive medium 75 assembled with one another for operation in a corresponding analysis device. Unit 70 and medium 75 are held together by one or more fasteners, clamps and/or latches 205 so that the upper surface of conductive rubber layer 185 is placed in secure thermal contact with the bottom surface of metal layer 190.

FIGS. 10A through 10D show a still further embodiment of a temperature control unit 40 that is particularly suitable for widespread economical commercial use. In accordance with this embodiment, first and second portions 210 and 215 of the temperature control unit 40 are connected by a hinge, shown generally at 220. The first and second portions 210 and 215 can be rotated with respect to one another between an open position, shown in FIG. 10B, and a closed position shown in FIG. 10C.

Figure 10D:
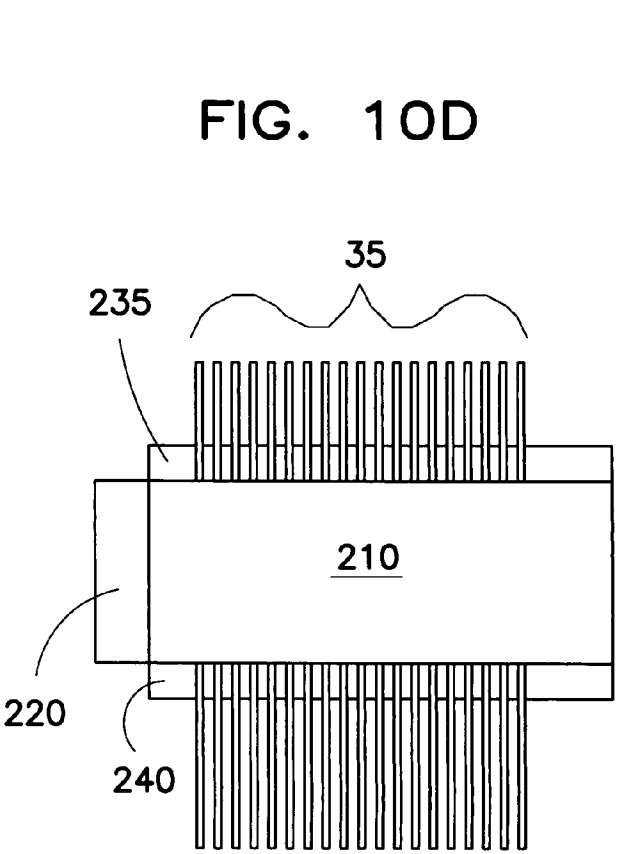
FIGS. 10A through 10D show a still further embodiment of a temperature control unit that is particularly suitable for widespread economical commercial use.
Figure 10A:
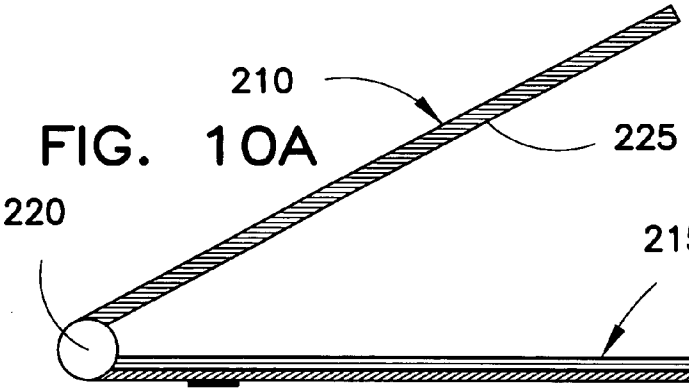

The basic components of the temperature control unit 40 while in the open position are illustrated in FIG. 10A. As shown, the first portion 210 of the temperature control unit 40 includes a plate 225 that, for example, is comprised of metal or another highly thermally conductive and rigid material. The second portion 215 of the temperature control unit 40 is comprised of a solid-state heating element 90 having a first side that is at least partially covered by a plate 230.

Figure 10B:
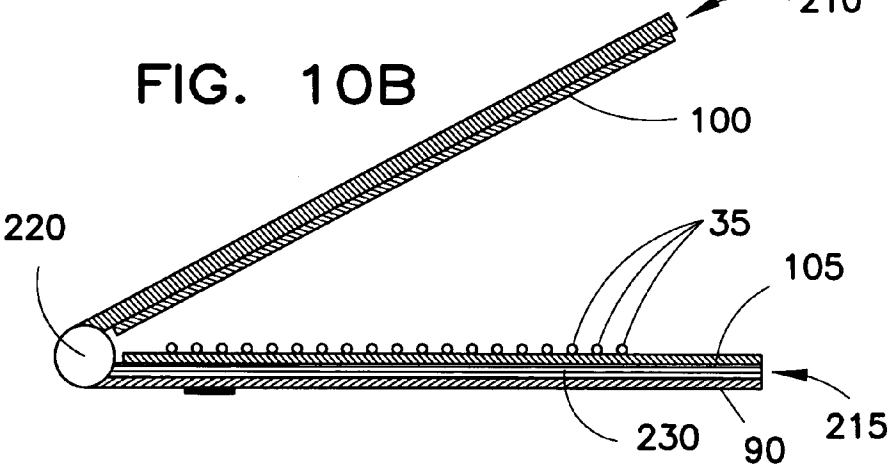
Figure 10C:
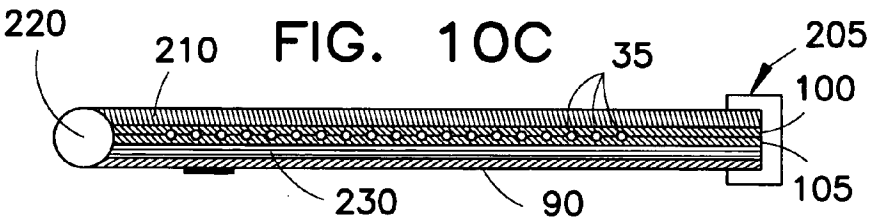

In the closed position of FIG. 10C, the array of capillary columns 35 are surrounded by a thermally conductive rubber material. The thermally conductive rubber material can be applied in any one of the manners described above. FIG. 10B shows the thermally conductive rubber material applied as two separate sheets 100 and 105. Sheet 100 is disposed to cover at least a portion of the interior surface of the upper portion 210 of the temperature control unit 40 while sheet 105 is disposed to cover at least a portion of the interior surface of the lower portion 215. The array of capillary columns 35 are arranged in the desired manner on the surface of sheet 105 before the upper and lower portions 210 and 215 are moved about hinge 220 to the closed position of FIG. 10C where the upper and lower portions are secured with one another by, for example, one or more fasteners, clamps or latches 205. Preferably, the surfaces of sheets 100 and 105 deform under the pressure provided by fastener 205 so that the thermally conductive rubber material substantially surrounds the exterior surface of the capillary columns 35 and thereby maximizes thermal energy transfer between the rubber material and the capillary columns.

Alignment of the capillary columns 35 on the surface of sheet 105 can be difficult, particularly where a large number of capillary columns are used in the analysis process. FIG. 10D is a top plan view of an arrangement of components that may be used to assist in this alignment process. In accordance with this arrangement, the capillary columns 35 are aligned with one another in one or more capillary guides. The illustrated embodiment employs both a capillary inlet guide 235 and a capillary outlet guide 240.

Capillary guides 235 and 240 may be constructed in a variety of manners. In one of its simplest forms, each guide 235 and 240 may be constructed as a block of material having a plurality of channels disposed therein corresponding to the desired alignment for the capillary columns. In such instances, the end-user may be charged with the responsibility for placing the capillary columns 35 in the respective channels. Alternatively, capillary guides 235 and 240 may be provided with the corresponding capillary columns 35 fixed therein as a single commercial unit. The end-user need only open the temperature control unit 40 in the manner shown in FIG. 10B, align the capillary guides 235 and 240 on each side of the temperature control unit 40, and close the temperature control unit 40 to the condition shown in FIG. 10C.

While the heating rate of the temperature control unit 40 is dependent on the material and mass of the intermediate conductive layer 95 and the power of the heating element 90, its cooling rate will generally depend on the overall area of the surfaces of the temperature control unit 40 that are exposed to the surrounding medium and the temperature difference between those surfaces and the environment immediately surrounding it. Generally stated, the cooling rate is dependent on the ratio of the thermal mass of the temperature control unit 70 to the total area of the temperature control unit that is exposed to the ambient environment and/or cooling unit. Lower ratios make the temperature control unit 40 highly suitable for use in processes requiring rapid temperature changes over time. In contrast, higher ratios make the temperature control unit 40 more suitable for use in processes requiring the temperature to remain highly stable. The chosen ratio may be tailored to meet the demands of a wide range of temperature controlled processes.

Figure 11:
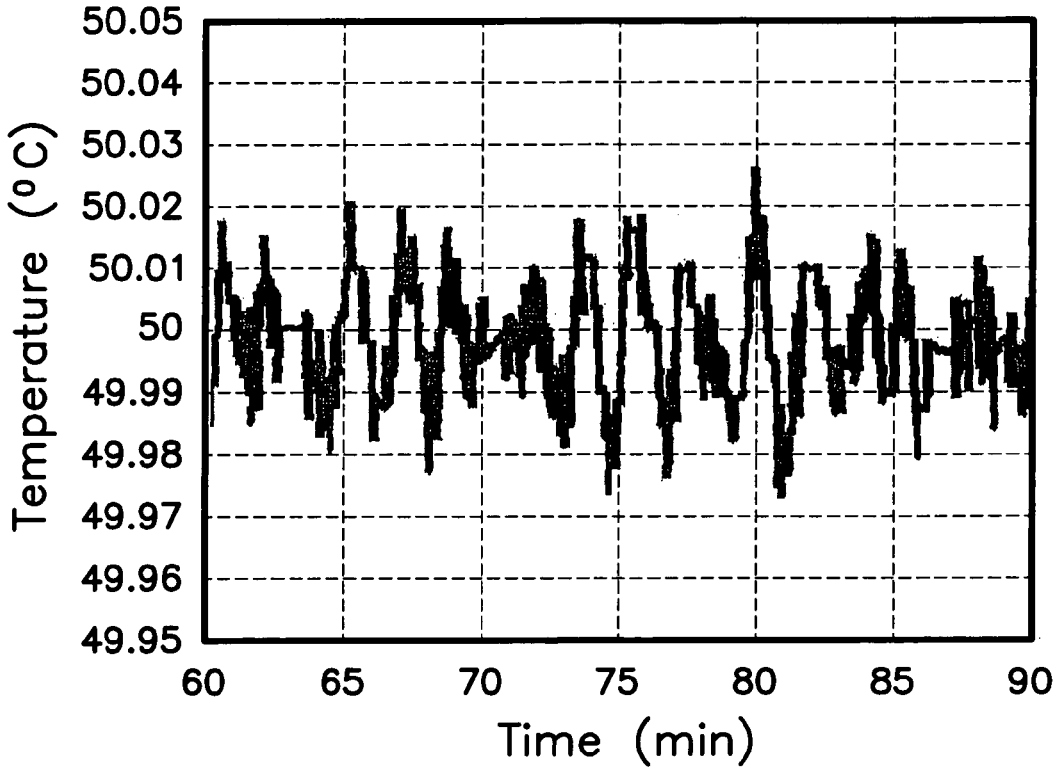
FIG. 11 is a graph of temperature versus time for one embodiment of a temperature control unit as it is operated at a constant target temperature.

FIG. 11 is a graph of temperature versus time of a temperature control unit 40 constructed in accordance with the specific embodiment shown in FIG. 8 and operated at a constant target temperature of 50° C. The heating unit 70 was designed to have a thermal mass to open surface area ratio of approximately 3.14 grams/square inch. As shown in FIG. 11, the temperature control unit 40 successfully maintained the temperature at 50° C. +/− 0.03° C., a degree of precision making the temperature control unit 40 highly suitable for analytical processes requiring strict temperature stability.

Figure 12:
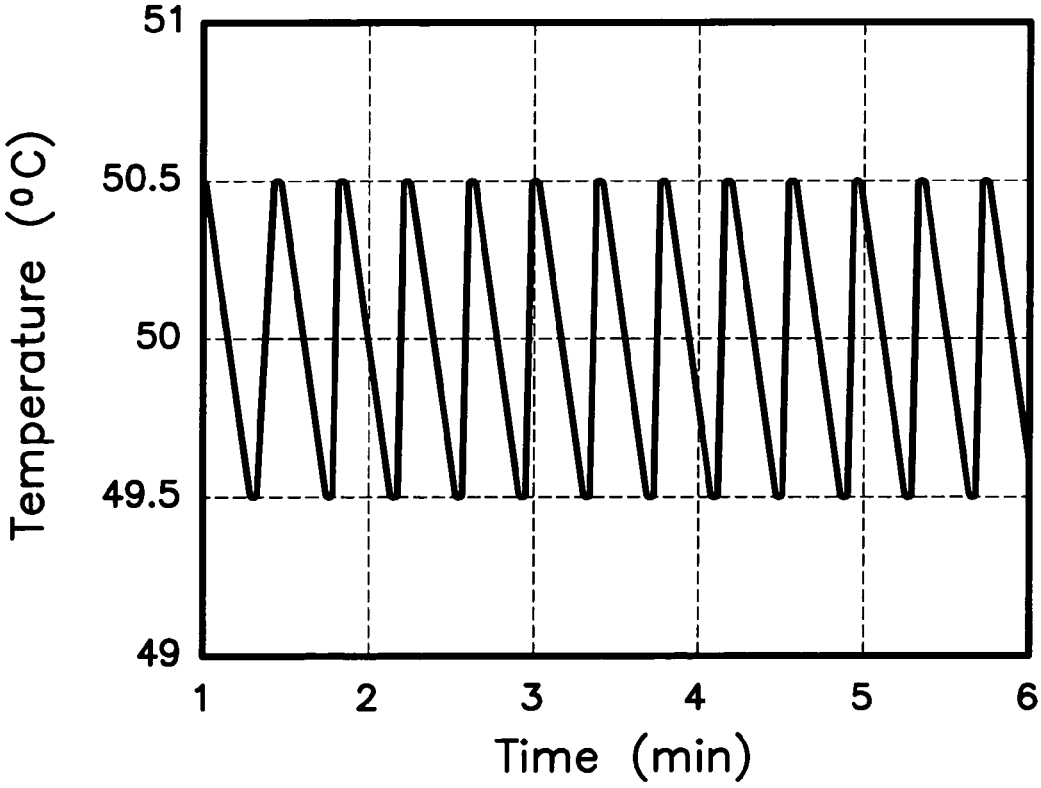
FIG. 12 is a graph of temperature versus time for the embodiment of temperature control unit tested in FIG. 8 as it is operated with a varying temperature profile.

FIG. 12 is a graph of temperature versus time for the same temperature control unit 40 as it was operated to cycle the temperature over time. In the illustrated process, the temperature was varied between 49.5° C. and 50.5° C. (an amplitude of 1° C.) with a cycle period of 25 seconds. Again, the temperature control unit 40 accurately tracked the target temperatures and provided the desired oscillatory temperature waveform making this same temperature control unit 40 highly suitable for analytical processes requiring a temperature profile that varies quickly over time. Heating rates as high as approximately 0.125° C./second and cooling rates as high as approximately 0.06° C./sec (in an ambient environment at room temperature) have been observed in connection with this embodiment. As shown in FIG. 12, these rates are consistent with the 8 seconds it took to raise the temperature by 1 degree C. and approximately 17 sec to lower the temperature by 1 degree C., giving a total cycle period of 25 sec. It will be recognized, however, that the temperature control unit can be designed to accommodate different heating and cooling rates as required by the specific analytical process.

Numerous modifications may be made to the foregoing apparatus without departing from the basic teachings thereof. As noted above, the apparatus may be used in connection with a variety of different chemical and/or biological analytical instruments. Therefore, although the present invention has been described in substantial detail with reference to one or more specific embodiments, those of skill in the art will recognize that changes may be made thereto without departing from the scope and spirit of the invention as set forth in the appended claims.

What is claimed is:

1. An apparatus for use in controlling the temperature of one or more substances passing through one or more microfluidics channels in an analysis device, the apparatus comprising:

a heating unit having opposed first and second surfaces, said first surface of said heating unit being at least partially exposed for cooling of said heating unit such that said first surface includes an exposed portion that does not contact another solid surface;

a thermally conductive medium disposed proximate the second surface of said heating unit, said one or more micro fluidics channels being disposed in said thermally conductive medium.

2. An apparatus as claimed in claim 1 wherein said thermally conductive medium is comprised of at least one layer of a thermally conductive rubber material.

3. An apparatus as claimed in claim 1 wherein the one or more of microfluidics channels are comprised of a plurality of capillary columns.

4. An apparatus as claimed in claim 3 and further comprising a heat dissipating unit contacting said thermally conductive medium opposite said heating unit.

5. An apparatus as claimed in claim 4 wherein said heat dissipating unit comprises a Peltier cooler.

6. An apparatus as claimed in claim 4 wherein said heat dissipating unit comprises a metal layer having a first side proximate said thermally conductive medium and a second side that is at least partially exposed for cooling of said metal layer.

7. An apparatus as claimed in claim 6 wherein the second side of said metal layer is exposed to the ambient atmosphere for cooling of said metal layer.

8. An apparatus as claimed in claim 3 wherein said first and second surfaces of said heating unit are generally parallel with and disposed opposite one another.

9. An apparatus as claimed in claim 3 wherein said first and second surfaces of said heating unit are generally coplanar.

10. An apparatus as claimed in claim 3 wherein said heating unit comprises:

a thin-film, electrical heating element having first and second opposed sides, said first opposed side of said thin-film, electrical heating element forming said first surface of said heating unit;

a metal layer disposed over at least a portion of the second opposed side of said thin-film, electrical heating element to conduct thermal energy between said thin-film, electrical heating element and said thermally conductive medium.

11. An apparatus as claimed in claim 3 wherein said thermally conductive medium is readily separated from said heating unit without damage to said heating unit.

12. An apparatus as claimed in claim 11 wherein said heating unit and said thermally conductive medium are secured with one another using one or more fasteners.

13. An apparatus as claimed in claim 11 wherein said thermally conductive medium is secured with said heating unit using an adhesive.

14. An apparatus as claimed in claim 11 wherein said thermally conductive medium is comprised of a thermally conductive silicone gel material.

15. An apparatus as claimed in claim 10 wherein said thermally conductive medium is disposed on said metal layer and is readily separated from said metal layer without damage to said heating unit.

16. An apparatus as claimed in claim 15 wherein said thermally conductive medium is comprised of a thermally conductive silicone gel material.

17. An apparatus as claimed in claim 16 and further comprising a heat dissipating unit contacting said thermally conductive medium opposite said heating unit.

18. An apparatus as claimed in claim 17 wherein said heat dissipating unit comprises a Peltier cooler.

19. An apparatus as claimed in claim 17 wherein said heat dissipating unit comprises a metal layer having a first side proximate said thermally conductive medium and a second side that is at least partially exposed for cooling of said metal layer.

20. An apparatus as claimed in claim 19 wherein the second side of said metal layer is exposed to the ambient atmosphere for cooling of said metal layer.

21. An apparatus as claimed in claim 3 wherein said first surface of said heating unit is exposed to ambient atmospheric conditions.

22. An apparatus for executing a capillary electrophoresis process comprising:

a first electrode unit adapted to receive one or more substances for electrophoretic analysis;

a second electrode unit;

a plurality of capillaries extending between said first and second electrode units and adapted to conduct said one or more substances therethrough;

a detection chamber disposed between the first and second electrode units and along said plurality of capillaries to detect one or more characteristics of said one or more substances passing through said plurality of capillaries;

a temperature control unit disposed between said first electrode unit and said detection chamber along said plurality of capillaries, said temperature control unit being adapted to control the temperature of said one or more substances passing through said plurality of capillaries, said temperature control unit including, a heating unit having first and second surfaces, said first surface of said heating unit being at least partially exposed to a fluid for cooling of said heating unit, a thermally conductive medium disposed proximate the second surface of said heating unit, said plurality of capillaries being disposed in said thermally conductive medium, and one or more temperature sensors disposed to detect the temperature at one or more sites of the temperature control unit;

a thermal controller programmed to execute a capillary electrophoresis process in which the energy provided to heat and/or cool the temperature control unit is varied at least in response to said one or more temperature sensors.

23. An apparatus as claimed in claim 22 wherein said thermally conductive medium is comprised of at least one layer of a thermally conductive rubber material.

24. An apparatus as claimed in claim 22 and further comprising a heat dissipating unit contacting said thermally conductive medium opposite said heating unit.

25. An apparatus as claimed in claim 24 wherein said heat dissipating unit comprises a Peltier cooler.

26. An apparatus as claimed in claim 24 wherein said heat dissipating unit comprises a metal layer having a first side proximate said thermally conductive medium and a second side that is at least partially exposed for cooling of said metal layer.

27. An apparatus as claimed in claim 26 wherein the second side of said metal layer is exposed to the ambient atmosphere for cooling of said metal layer.

28. An apparatus as claimed in claim 22 wherein said first and second surfaces of said heating unit are generally parallel with and disposed opposite one another.

29. An apparatus as claimed in claim 22 wherein said first and second surfaces of said heating unit are generally coplanar.

30. An apparatus as claimed in claim 22 wherein said heating unit comprises:

a thin-film, electrical heating element having first and second opposed sides, said first opposed side of said thin-film, electrical heating element forming said first surface of said heating unit;

a metal layer disposed over at least a portion of the second opposed side of said thin-film, electrical heating element to conduct thermal energy between said thin-film, electrical heating element and said thermally conductive medium.

31. An apparatus as claimed in claim 22 wherein said thermally conductive medium is readily separated from said heating unit without damage to said heating unit.

32. An apparatus as claimed in claim 31 wherein said thermally conductive medium is secured with said heating unit using an adhesive.

33. An apparatus as claimed in claim 31 wherein said thermally conductive medium is secured with said heating unit using a mechanical fastener.

34. An apparatus as claimed in claim 31 wherein said thermally conductive medium is comprised of a thermally conductive silicone material.

35. An apparatus as claimed in claim 30 wherein said thermally conductive medium is disposed on said metal layer and is readily separated from said metal layer without damage to said heating unit.

36. An apparatus as claimed in claim 35 wherein said thermally conductive medium is comprised of a thermally conductive silicone material.

37. An apparatus as claimed in claim 22 wherein said first surface of said heating unit is exposed to ambient atmospheric conditions such that said fluid comprises a gas.

38. An apparatus for use in controlling the temperature of one or more substances passing through one or more microfluidics channels in an analysis device, the apparatus comprising:

a planar shaped heating unit having first and second opposing surfaces, said first surface of said heating unit being at least partially exposed for cooling of said heating unit such that said first surface includes an exposed portion in contact with a liquid or a gas;

a thermally conductive medium disposed proximate the second surface of said heating unit, said one or more microfluidics channels being disposed in said thermally conductive medium.

39. An apparatus as claimed in claim 38 wherein the one or more microfluidics channels comprise a capillary column.

40. The apparatus as claimed in claim 38 wherein the exposed portion of said first surface of said heating unit is in contact with a flow of liquid or gas.

41. The apparatus of claim 38 wherein the first and second opposing surfaces each have a substantially greater surface area than any other surface of the planar shaped heating unit.

42. The apparatus of claim 41 wherein the planar shaped heating unit is formed as a multilayer composite.

43. The apparatus of claim 42 wherein the planar shaped heating unit comprises a heating element and an intermediate conductive or convective layer, wherein the intermediate conductive or convective layer is disposed between the heating element and the thermally conductive medium.

44. The apparatus of claim 38 wherein said thermally conductive medium comprises a first portion disposed proximate a thermally conductive plate, and a second portion disposed proximate the second surface of said heating unit.

45. The apparatus of claim 44 further comprising a hinge structure connecting said thermally conductive plate and said heating unit for relative rotational movement about a hinge axis.

46. The apparatus of claim 45 wherein said heating unit and said thermally conductive plate are configured to rotate about said hinge axis between an operative position in which said one or more microfluidics channels are secured between and in substantial thermal contact with said first portion of thermally conductive material and said second portion of thermally conductive material, and an inoperative position in which said first portion of thermally conductive material is separated from said second portion of thermally conductive material.

47. The apparatus of claim 22 wherein the fluid is a liquid.

48. The apparatus of claim 22 wherein the fluid is a gas.

* * * * *